US007578581B2

(12) United States Patent
Watanabe

(10) Patent No.: US 7,578,581 B2
(45) Date of Patent: Aug. 25, 2009

(54) INK JET PRINTER

(75) Inventor: Hidetoshi Watanabe, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 466 days.

(21) Appl. No.: 11/302,459

(22) Filed: Dec. 14, 2005

(65) Prior Publication Data

US 2006/0125878 A1 Jun. 15, 2006

(30) Foreign Application Priority Data

Dec. 14, 2004 (JP) ..... 2004-361308

(51) Int. Cl.
*B41J 2/14* (2006.01)
*B41J 2/05* (2006.01)
*B41J 2/045* (2006.01)

(52) U.S. Cl. ..... 347/50; 347/58; 347/71

(58) Field of Classification Search ..... 347/68–72, 347/50, 58, 71
See application file for complete search history.

(56) References Cited

U.S. PATENT DOCUMENTS

| | | | | |
|---|---|---|---|---|
| 6,547,376 | B1 | 4/2003 | Watanabe et al. | |
| 6,672,715 | B2 | 1/2004 | Isono et al. | |
| 2002/0003560 | A1 * | 1/2002 | Isono et al. | 347/72 |
| 2002/0196315 | A1 | 12/2002 | Isono et al. | |
| 2003/0156167 | A1 | 8/2003 | Sakaida et al. | |
| 2004/0218018 | A1 | 11/2004 | Sakaida et al. | |
| 2005/0185028 | A1 | 8/2005 | Sakaida et al. | |
| 2006/0164476 | A1 | 7/2006 | Watanabe et al. | |
| 2006/0284939 | A1 | 12/2006 | Katayama | |
| 2006/0284940 | A1 | 12/2006 | Katayama | |

FOREIGN PATENT DOCUMENTS

| | | | |
|---|---|---|---|
| EP | 0925923 | A1 | 6/1996 |
| EP | 1 336 494 | A1 * | 8/2003 |
| EP | 1336494 | A | 8/2003 |
| EP | 1338421 | A2 | 8/2003 |

(Continued)

OTHER PUBLICATIONS

European Search Report (3 pages) for counterpart European patent application.

(Continued)

*Primary Examiner*—Stephen D Meier
*Assistant Examiner*—Geoffrey Mruk
(74) *Attorney, Agent, or Firm*—Baker Botts L.L.P.

(57) ABSTRACT

An ink jet printer is provided with an ink jet head. The ink jet head includes an ink passage body and an actuator. The ink passage body includes a nozzle, an ink chamber communicating with the nozzle, and a pressure chamber located between the nozzle and the ink chamber. The actuator includes a piezoelectric element facing the pressure chamber. The piezoelectric element includes a piezoelectric layer, a first electrode connected with a front face of the piezoelectric layer, a second electrode connected with a back face of the piezoelectric layer, and a first insulator located between the second electrode and the ink passage body. The ink jet printer further includes a device for maintaining the electric potentials of the ink passage body and the second electrode such that the electric potential of the ink passage body is equal to or below the electric potential of the second electrode.

13 Claims, 10 Drawing Sheets

FOREIGN PATENT DOCUMENTS

| | | | |
|---|---|---|---|
| EP | 1372199 | A1 | 12/2003 |
| EP | 1393906 | A1 | 3/2004 |
| JP | S61-079669 | A | 4/1986 |
| JP | 11 198371 | | 7/1999 |
| JP | 2001309672 | A | 2/2001 |
| JP | 2001 260353 | | 9/2001 |
| JP | 2003-053982 | A | 2/2003 |
| JP | 2003-080709 | A | 3/2003 |
| JP | 2003 94653 | | 4/2003 |

OTHER PUBLICATIONS

State Intellectual Property Office, Notification of First Office Action in Chinese Patent Appl'n No. 200610093814.X mailed Feb. 15, 2008.
State Intellectual Property Office, Notification of First Office Action in Chinese Patent Appl'n No. 200610093815.4 mailed Feb. 15, 2008.
United States Patent and Trademark Office, Office Action dated Jul. 29, 2008 in U.S. Appl. No. 11/302,521.
Japan Patent Office, Notification of Reasons for Rejection mailed Sep. 24, 2008, in Patent Application No. JP 2005-179415 (counterpart to Patent Publication No. US 2006/0284939 A1).
European Patent Office, European Search Report mailed Dec. 6, 2006, in Patent Application No. EP 06012513 (counterpart to Patent Publication No. US 2006/0284939 A1).
European Patent Office, European Search Report mailed Sep. 25, 2006, in Patent Application No. EP 06012514 (counterpart to Patent Publication No. US 2006/0284940 A1).
U.S. Patent and Trademark Office, Office Action in co-pending U.S. Appl. No. 11/425,215, Notification Date May 19, 2009.
U.S. Patent and Trademark Office, Office Action in co-pending U.S. Appl. No. 11/425,199, Notification Date Apr. 17, 2009.

* cited by examiner

INK JET PRINTER

CROSS-REFERENCED TO RELATED APPLICATION

This application claims priority to Japanese Patent Application No. 2004-361308, filed on Dec. 14, 2004, the contents of which are hereby incorporated by reference into the present application.

BACKGROUND OF THE INVENTION

1. Field of the Invention

The present invention relates to an ink jet printer. The ink jet printer of the present invention includes all devices for printing words, images, etc. by discharging ink towards a print medium. For example, the ink jet printer of the present invention includes copying machines, fax machines, multi-functional products, etc.

2. Description of the Related Art

An ink jet printer has an ink jet head. Usually, the ink jet head comprises an ink passage body and an actuator. The ink passage body comprises a nozzle, an ink chamber, and a pressure chamber. The nozzle discharges ink toward a print medium. The ink chamber houses ink, and the ink chamber and the nozzle communicate. The pressure chamber is disposed between the nozzle and the ink chamber. The actuator comprises a piezoelectric element facing the pressure chamber. There is a piezoelectric element of the following type: the piezoelectric element comprises a piezoelectric layer, a first electrode connected with a front face of the piezoelectric layer, a second electrode connected with a back face of the piezoelectric layer, and a middle layer located between the second electrode and the ink passage body. When an electric potential difference is applied between the first electrode and the second electrode, the piezoelectric layer may contract in a planar direction. The first electrode, the second electrode, and the middle layer cannot contract in the planar direction. As a result, the force for causing the piezoelectric layer to contract in the planar direction is converted into force that bends the entire piezoelectric element in its direction of thickness. Therefore, the piezoelectric element may protrude toward the pressure chamber when the electric potential difference is applied between the first electrode and the second electrode. The capacity of the pressure chamber is reduced when the piezoelectric element protrudes toward the pressure chamber. The pressure of the ink within the pressure chamber is thus increased, and the ink is discharged from the nozzle. When the electric potential difference between the first electrode and the second electrode is cancelled, the state in which the piezoelectric element was protruding toward the pressure chamber is released. The capacity within the pressure chamber is thus increased, and ink is drawn from the ink chamber into the pressure chamber.

When the middle layer is present between the second electrode and the ink passage body, there is a greater amount of transformation in the direction of thickness of the piezoelectric element. Usually, an insulator is utilized in this middle layer. With this configuration, pressure within the pressure chamber may be efficiently increased and decreased. An ink jet printer having the aforementioned configuration is taught in U.S. Pat. No. 6,672,715.

If a print medium (printing paper for example) is charged, an electric charge may be conveyed from the print medium to the ink passage body. The ink passage body may thus be charged, and the electric potential of the ink passage body may become greater than the electric potential of the second electrode. In this case, the components of the ink (mainly hydrogen ions) within the ink passage body are attracted towards the actuator (the second electrode). The components of the ink may enter the actuator, and if hydrogen ions enter the actuator, hydrogen gas may be formed within the actuator. If hydrogen gas is formed within the actuator, the layers within the actuator (e.g. the piezoelectric layer and the second electrode) may separate.

The present invention sets forth a technique capable of preventing the components of the ink within the ink passage body from entering the actuator.

BRIEF SUMMARY OF THE INVENTION

An ink jet printer taught in the present specification comprises a device that maintains the electric potentials of the ink passage body and the second electrode such that the electric potential of the ink passage body is equal to or below the electric potential of the second electrode.

With this configuration, the electric potential of the ink passage body is maintained at equal or below the electric potential of the second electrode. As a result, the components (mainly hydrogen ions) of the ink within the ink passage body may not enter the actuator.

BRIEF DESCRIPTION OF THE DRAWINGS

In FIG. 3, pressure chambers, apertures, and nozzles are shown by solid lines.

FIG. 10(*b*) shows two discharging pulse signals and one canceling pulse signal. FIG. 10(*c*) shows three discharging pulse signals and one canceling pulse signal. FIG. 10(*d*) shows a high electric potential signal. FIG. 10(*e*) shows a low electric potential signal.

DETAILED DESCRIPTION OF THE INVENTION

Embodiment

Figure 1:
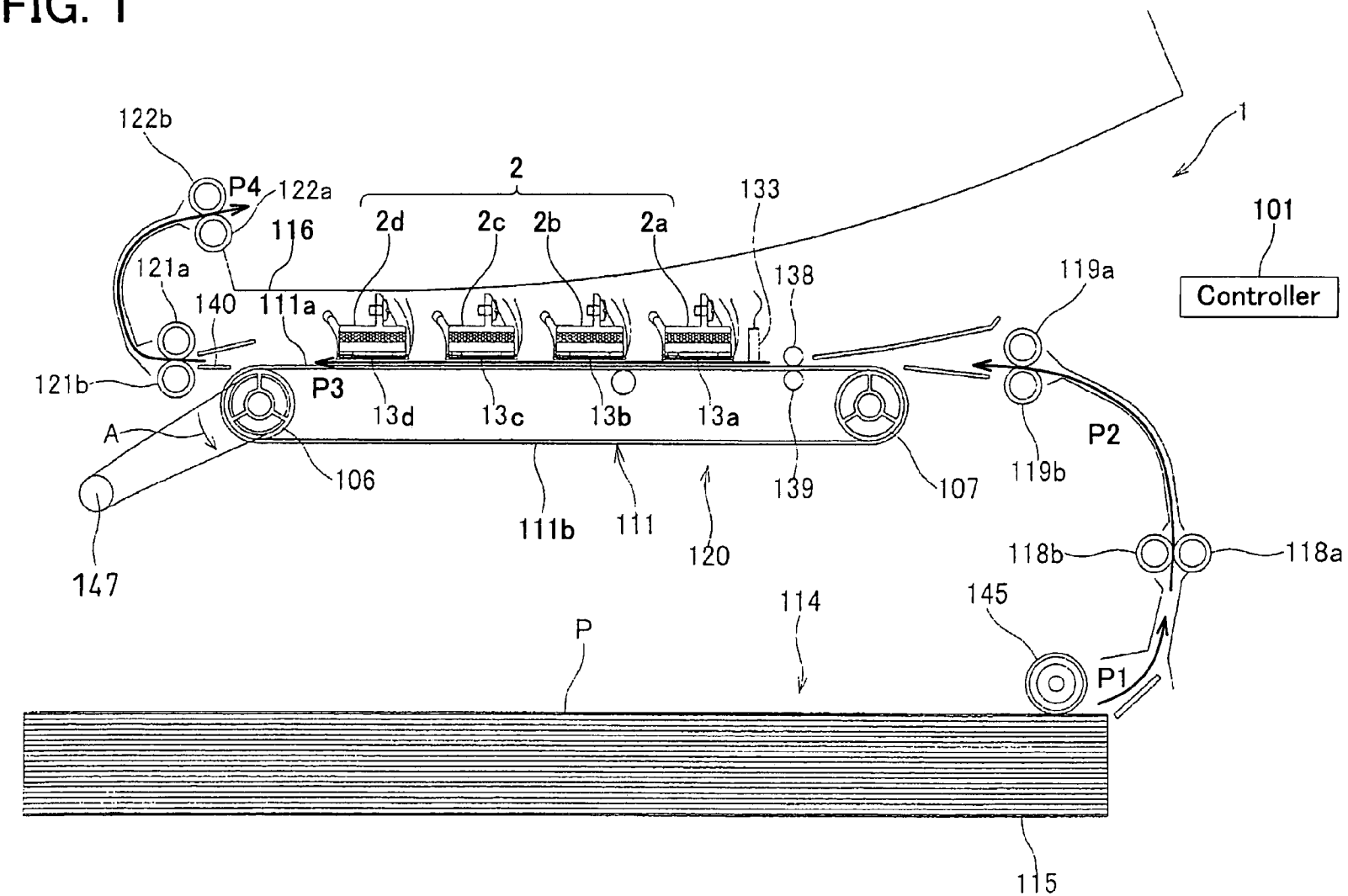
FIG. 1 shows a schematic view of an ink jet printer.

An ink jet printer 1 of an embodiment will be described with reference to the drawings. Below, the ink jet printer 1 may simply be referred to as printer 1. FIG. 1 is a schematic view of the printer 1.

The printer 1 has a controller 101. The controller 101 executes general control of the operation of the printer 1.

The printer 1 has a paper supply device 114. This paper supply device 114 has a paper housing section 115, a paper supply roller 145, a pair of rollers 118*a* and 118*b*, a pair of rollers 119*a* and 119*b*, etc. The paper housing section 115 can house a plurality of sheets of printing paper P in a stacked state. The printing paper P has a rectangular shape extending in the left-right direction of FIG. 1. The paper supply roller 145 delivers the uppermost sheet of printing paper P in the paper housing section 115 in the direction of the arrow P1. The printing paper P that was transported in the direction of the arrow P1 is then transported in the direction of the arrow P2 by the pair of rollers 118*a* and 118*b* and the pair of rollers 119*a* and 119*b*.

The printer 1 has a conveying unit 120. The conveying unit 120 conveys the printing paper P, which has been transported in the direction of the arrow P2, in the direction P3. The conveying unit 120 has a belt 111, belt rollers 106 and 107, etc. The belt 111 is wound across the belt rollers 106 and 107. The belt 111 is adjusted to have a length such that a predetermined tension is generated when it is wound across the belt rollers 106 and 107. The belt 111 has an upper face 111*a* that is located above the belt rollers 106 and 107, and a lower face 111*b* that is located below the belt rollers 106 and 107. The first belt roller 106 is connected to a conveying motor 147. The conveying motor 147 is caused to rotate by the controller 101. The other belt roller 107 rotates following the rotation of the belt roller 106. When the belt rollers 106 and 107 rotate, the printing paper P mounted on the upper face 111*a* of the belt 111 is conveyed in the direction shown by the arrow P3.

A pair of nip rollers 138 and 139 is disposed near the belt roller 107. The upper nip roller 138 is disposed at an outer peripheral side of the belt 111. The lower nip roller 139 is disposed at an inner peripheral side of the belt 111. The belt 111 is gripped between the pair of nip rollers 138 and 139. The nip roller 138 is energized downwards by a spring (not shown). The nip roller 138 pushes the printing paper P onto the upper face 111*a* of the belt 111. In the present embodiment, an outer peripheral face of the belt 111 comprises adhesive silicon gum. As a result, the printing paper P adheres reliably to the upper face 111*a* of the belt 111.

A sensor 133 is disposed to the left of the nip roller 138. The sensor 133 is a light sensor comprising a light emitting element and a light receiving element. The sensor 133 detects a tip of the printing paper P. Detection signals of the sensor 133 are sent to the controller 101. The controller 101 can determine that the printing paper P has reached a detecting position when the detection signals from the sensor 133 are input.

The printer 1 has a head unit 2. The head unit 2 is located above the conveying unit 120. The head unit 2 has four ink jet heads 2*a*, 2*b*, 2*c*, and 2*d*. The ink jet heads 2*a* to 2*d* are all fixed to a printer main body (not shown). The ink jet heads 2*a* to 2*d* have ink discharging faces 13*a* to 13*d* respectively. The ink discharging faces 13*a* to 13*d* are formed at lower faces of the ink jet heads 2*a* to 2*d*. Ink is discharged downwards from the ink discharging faces 13*a* to 13*d* of the ink jet heads 2*a* to 2*d*. The ink jet heads 2*a* to 2*d* have an approximately rectangular parallelopiped shape that extends in a perpendicular direction relative to the plane of the page of FIG. 1. Magenta (M) ink is discharged from the ink jet head 2*a*. Yellow (Y) ink is discharged from the ink jet head 2*b*. Cyan (C) ink is discharged from the ink jet head 2*c*. Black (K) ink is discharged from the ink jet head 2*d*. In the present embodiment, four colors of ink can be used to perform color printing of the printing paper P. The configuration of the ink jet heads 2*a* to 2*d* will be described in detail later. The operation of the ink jet heads 2*a* to 2*d* is controlled by the controller 101.

A space is formed between the ink discharging faces 13*a* to 13*d* of the ink jet heads 2*a* to 2*d* and the upper face 111*a* of the belt 111. The printing paper P is transported towards the left (in the direction of the arrow P3) along this space. Ink is discharged from the ink jet heads 2*a* to 2*d* onto the printing paper P during this process of delivery in the direction of the arrow P3. The printing paper P is thus printed with color words or images. In the present embodiment, the ink jet heads 2*a* to 2*d* are fixed. That is, the printer 1 of the present embodiment is a line type printer.

A plate 140 is supplied to the left of the conveying unit 120. When the printing paper P is transported in the direction of the arrow P3, a right edge of the plate 140 enters between the printing paper P and the belt 111, thus separating the printing paper P from the belt 111.

A pair of rollers 121*a* and 121*b* is formed to the left of the plate 140. Further, a pair of rollers 122*a* and 122*b* is formed above the pair of rollers 121*a* and 121*b*. The printing paper P, which has been transported in the direction of the arrow P3, is transported in the direction of an arrow P4 by the pair of rollers 121*a* and 121*b* and the pair of rollers 122*a* and 122*b*. A paper discharge section 116 is disposed to the right of the rollers 122*a* and 122*b*. The printing paper P that has been transported in the direction of the arrow P4 is received in the paper discharge section 116. The paper discharge section 116 can maintain a plurality of printed sheets of printing paper P in a stacked state.

Next, the configuration of the ink jet head 2*a* will be described. Since the other ink jet heads 2*b* to 2*d* have the same configuration as the ink jet head 2*a*, a detailed description thereof will be omitted.

Figure 2:
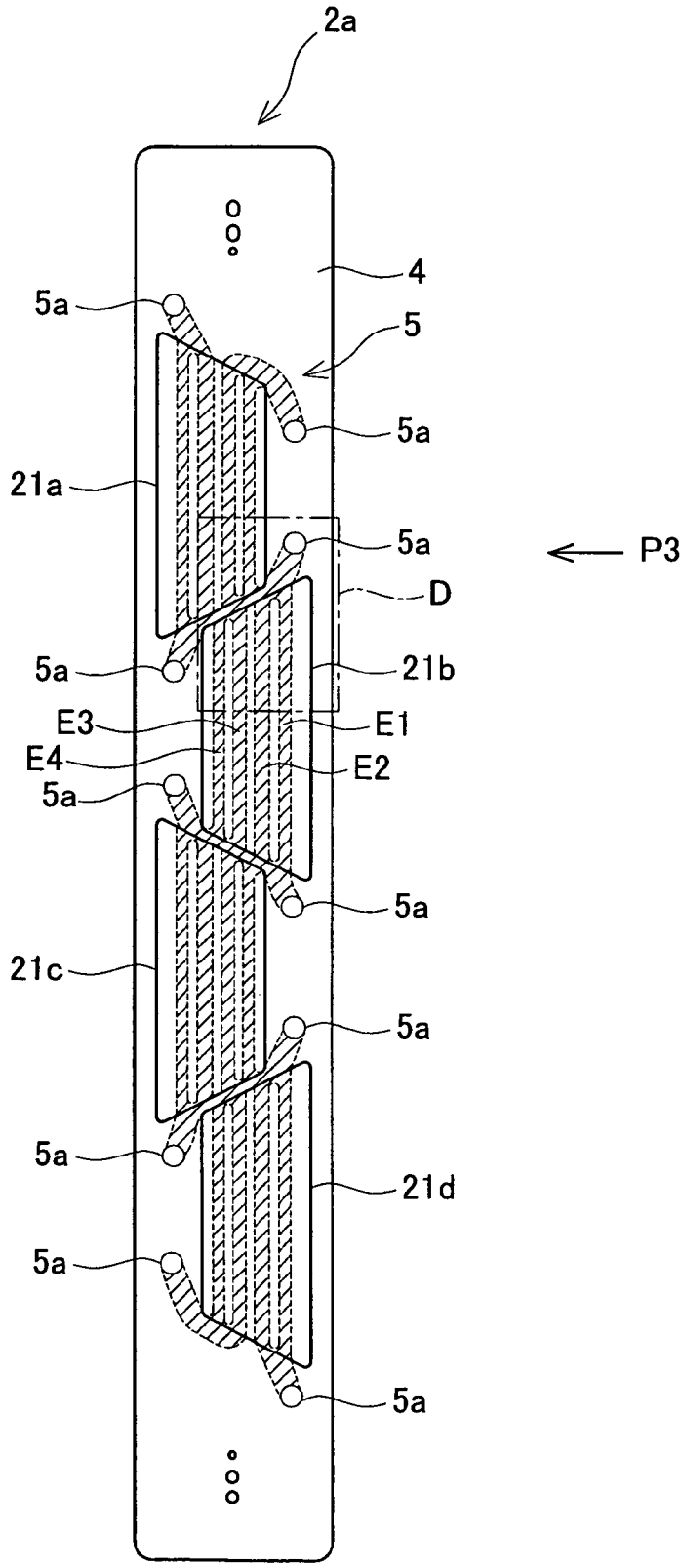
FIG. 2 shows a plan view of an ink jet head.

FIG. 2 shows a plan view of the ink jet head 2*a* viewed from above FIG. 1. The ink jet head 2*a* has an ink passage body 4 and four actuator units 21*a*, 21*b*, 21*c*, and 21*d*.

Ink passages 5 are formed within the ink passage body 4. In FIG. 2, main ink passages 5 within the ink passage body 4 are shown by hatching. A plurality of openings 5*a* are formed in a surface (a face of a proximate side perpendicular to the plane of FIG. 2) of the ink passage body 4. These openings 5*a* are connected to an ink tank (not shown). In the case of the ink jet head 2*a*, the openings 5*a* are connected to an ink tank that houses magenta ink. The ink in the ink tank is led into the ink passage body 4 via the openings 5*a*. The ink discharging face 13*a* is formed at a lower face (a face of a far side perpendicular to the plane of FIG. 2) of the ink passage body 4.

The ink passages 5 of the ink passage body 4 have ink chambers E1 to E4. The ink chambers E1 to E4 are formed in a region that faces the actuator units 21*a* to 21*d*. In FIG. 2, reference numbers have been applied only to the ink chambers E1 to E4 facing the actuator unit 21*b*. Actually, however, four ink chambers are also formed in a region facing the actuator unit 21*a*, and four ink chambers are formed respectively in regions facing the actuator units 21*c* and 21*d*. The four ink chambers E1 to E4 each extend in the up-down direction of FIG. 2. The ink chambers E1 to E4 are aligned so as to be parallel in the left-right direction of FIG. 2. The ink chambers E1 to E4 are filled with ink that was introduced from the ink tank via the openings 5*a*.

The four actuator units 21*a* to 21*d* are fixed to the surface (a face of the proximate side perpendicular to the plane of FIG. 2) of the ink passage body 4. The actuator units 21*a* to 21*d* each have a trapezoid shape when viewed from a plan view. The actuator units are aligned in the sequence 21*a*, 21*b*, 21*c*, and 21*d* from an upper side of FIG. 2. The actuator units 21*a* and 21*c* are disposed such that short edges thereof are at the right side and long edges thereof are at the left side. The actuator units 21*b* and 21*d* are disposed such that short edges thereof are at the left side and long edges thereof are at the right side. The actuator units 21*a* and 21*b* are disposed so as to overlap in the left-right direction of FIG. 2. Further, the actuator units 21*a* and 21*b* are disposed so as to overlap in the up-down direction of FIG. 2. Similarly, the actuator units 21*b* and 21*c* are disposed so as to overlap in the left-right direction and the up-down direction. The actuator units 21*c* and 21*d* are disposed so as to overlap in the left-right direction and the up-down direction. The actuator units 21 are disposed in a staggered pattern.

An FPC 50 (Flexible Printed Circuit: not shown here, see FIG. 4, etc.) is connected to the actuator units 21*a* to 21*d*. The FPC 50 applies discharging pulse signals (to be described) to the actuator units 21*a* to 21*d*. The actuator units 21*a* to 21*d* increase or reduce the pressure of ink within pressure chambers 10 (to be described: see FIG. 3, etc.) of the ink passage body 4 in response to the pulse signals.

Below, unless otherwise specified, the actuator units 21*a* to 21*d* are represented the reference number 21.

Figure 3:
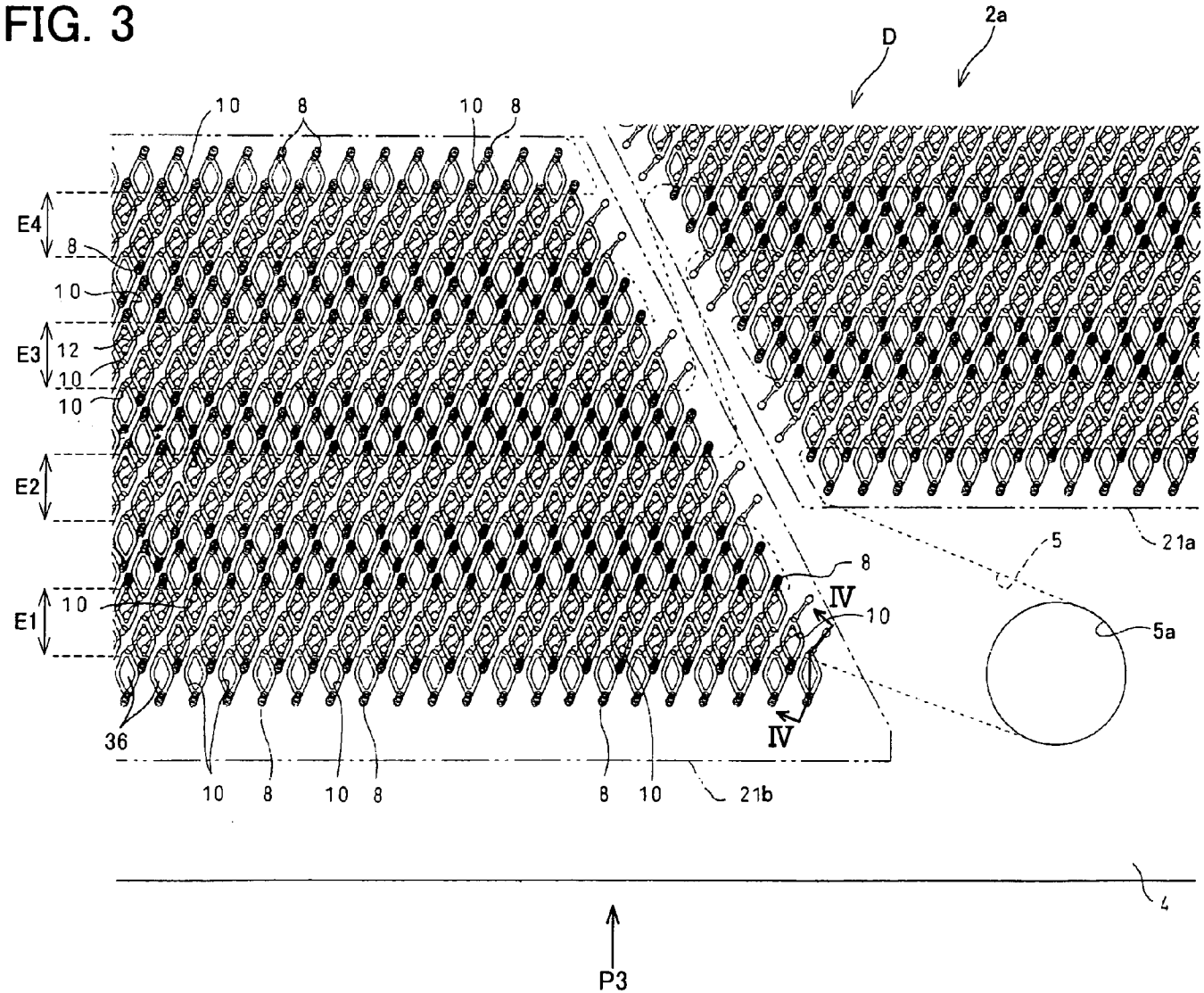
FIG. 3 shows an expanded view of a region D of FIG. 2.

FIG. 3 is an expanded plan view of a region D of FIG. 2. In FIG. 3, nozzles 8, pressure chambers 10, and apertures 12 which actually cannot be seen are shown by solid lines.

As shown in FIG. 3, a plurality of nozzles 8, a plurality of pressure chambers 10 and a plurality of apertures 12, etc. are formed within the ink passage body 4. The number of nozzles 8, of pressure chambers 10, and of apertures 12 is identical. In FIG. 3, not all the nozzles 8, pressure chambers 10, and apertures 12 are numbered.

The actuator units 21 have a plurality of individual electrodes 36. One individual electrode 36 faces one pressure chamber 10. The number of individual electrodes 36 is identical with the number of pressure chambers 10.

Figure 4:
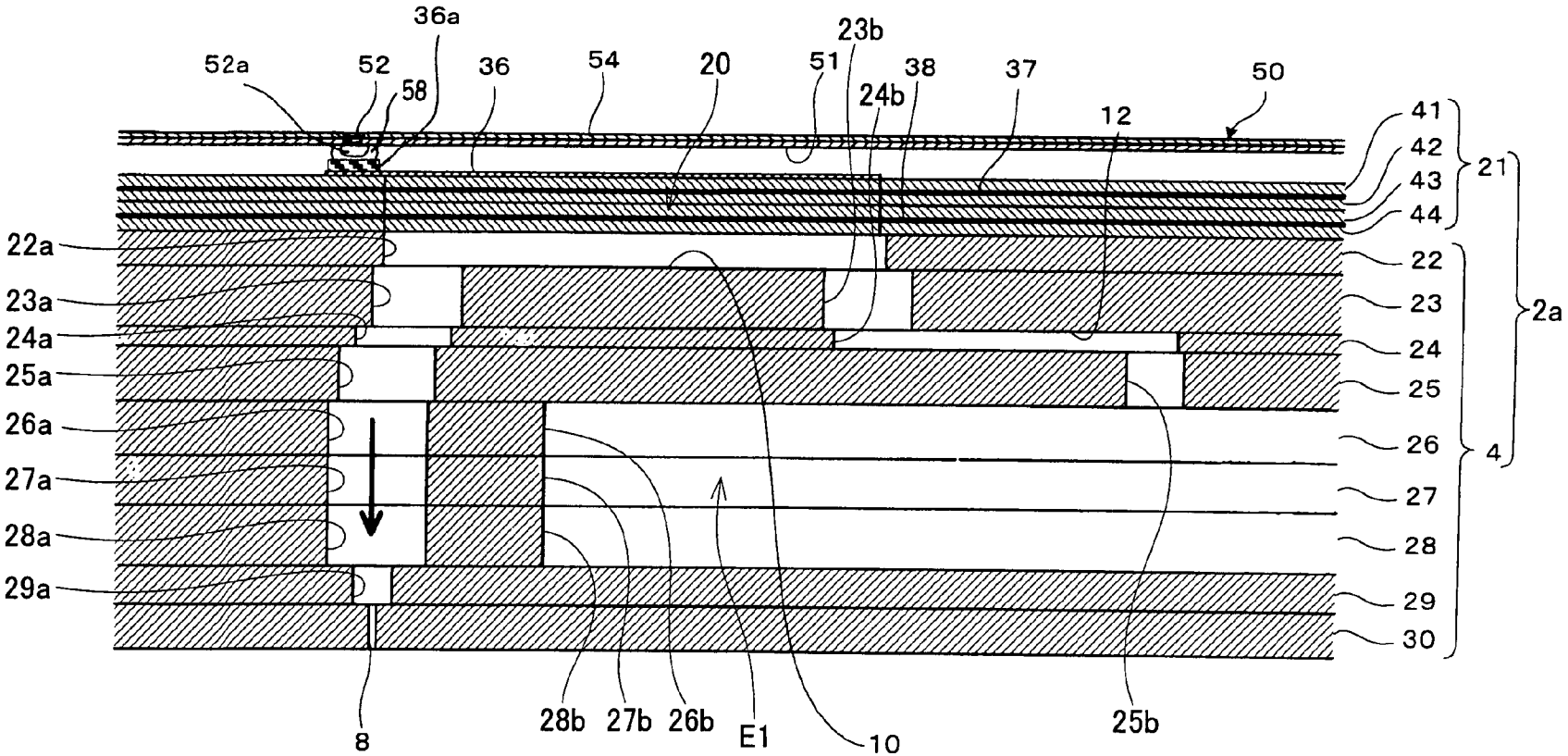
FIG. 4 shows a cross-sectional view along the line IV-IV of FIG. 3.

The structure of the ink passage body 4 and the actuator unit 21 will be described in detail with reference to FIG. 4. FIG. 4 is a cross-sectional view along the line IV-IV of FIG. 3.

The ink passage body 4 is a structure in which nine metal plates 22 to 30 have been stacked. The nozzles 8 are formed in a nozzle plate 30, and pass through this nozzle plate 30. Only one nozzle 8 is shown in FIG. 4. However, a plurality of nozzles 8 is actually formed (see FIG. 3).

A cover plate 29 is stacked on a surface of the nozzle plate 30. A through hole 29*a* is formed in the cover plate 29. The through hole 29*a* is formed in a position corresponding to the nozzle 8 of the nozzle plate 30.

Three manifold plates 26, 27, and 28 are stacked on a surface of the cover plate 29. A through hole 26*a* is formed in the manifold plate 26, a through hole 27*a* is formed in the manifold plate 27, and a through hole 28*a* is formed in the manifold plate 28. The through holes 26*a*, 27*a*, and 28*a* are formed in a position corresponding to the through hole 29*a* of the cover plate 29. The manifold plates 26, 27, and 28 have long holes 26*b*, 27*b*, and 28*b* respectively. The long holes 26*b*, 27*b*, and 28*b* have the shape of the ink passages 5 shown in FIGS. 2 and 3. The long holes 26*b*, 27*b*, and 28*b* are each formed in the same position. Spaces formed by the long holes 26*b*, 27*b*, and 28*b* are the ink passages 5. In FIG. 4, the ink chamber E1, which is a part of the ink passage 5, is shown.

A supply plate 25 is stacked on a surface of the manifold plate 26. A through hole 25*a* is formed in the supply plate 25. The through hole 25*a* is formed in a position corresponding to the through hole 26*a* of the manifold plate 26. Further, a through hole 25*b* is formed in the supply plate 25. The through hole 25*b* is formed in a position corresponding to the long hole 26*b* of the manifold plate 26.

An aperture plate 24 is stacked on a surface of the supply plate 25. A through hole 24*a* is formed in the aperture plate 24. The through hole 24*a* is formed in a position corresponding to the through hole 25*a* of the supply plate 25. Further, a long hole 24*b* is formed in the aperture plate 24. A right edge of the long hole 24*b* is formed in a position corresponding to the through hole 25*b* of the supply plate 25. The long hole 24*b* functions as the apertures 12.

A base plate 23 is stacked on a surface of the aperture plate 24. A through hole 23*a* is formed in the base plate 23. The through hole 23*a* is formed in a position corresponding to the through hole 24*a* of the aperture plate 24. Further, a through hole 23*b* is formed in the base plate 23. The through hole 23*b* is formed in a position corresponding to left edge of the long hole 24*b* of the aperture plate 24.

A cavity plate 22 is stacked on a surface of the base plate 23. A long hole 22*a* is formed in the cavity plate 22. A left edge of the long hole 22*a* is formed in a position corresponding to the through hole 23*a* of the base plate 23. A right edge of the long hole 22*a* is formed in a position corresponding to the through hole 23*b* of the base plate 23. The long hole 22*a* functions as the pressure chambers 10. The pressure chamber 10 communicates with the ink chamber E1 via the through hole 23*b*, the aperture 12, and the through hole 25*b*. Further, the pressure chamber 10 communicates with the nozzle 8 via the through hole 23*a*, the through hole 24*a*, the through hole 25*a*, the through hole 26*a*, the through hole 27*a*, the through hole 28*a*, and the through hole 29*a*.

As shown in FIG. 3, the pressure chambers 10 are substantially diamond shaped when viewed from a plan view. The plurality of pressure chambers 10 is aligned in a staggered pattern. One pressure chamber row is formed by aligning a plurality of the pressure chambers 10 in a direction orthogonal to the direction of the arrow P3 (the left-right direction of FIG. 3). Sixteen pressure chamber rows are aligned in the direction of P3 within a region corresponding to one actuator unit 21. Each pressure chamber 10 communicates with one out of the ink chambers E1 to E4.

One nozzle row is formed by aligning a plurality of the nozzles 8 in a direction orthogonal to the direction of the arrow P3. Sixteen nozzle rows are aligned in the direction of P3 within a region corresponding to one actuator unit 21. Each nozzle 8 communicates with one out of the pressure chambers 10. As shown in FIG. 3, when the ink jet head 2 is viewed from a plan view, none of the nozzles 8 overlap with the ink chambers E1 to E4.

The nozzles 8 are mutually offset in the direction orthogonal to the direction of the arrow P3. That is, if the nozzles 8 are projected from the direction of P3 on a straight line (a projective line) extending in the direction orthogonal to the arrow P3, the nozzles 8 will be present at differing positions on this projective line. The nozzles 8 are equally spaced on the projective line. This spacing is a distance corresponding to 600 dpi. This 600 dpi is the resolution in the direction orthogonal to the arrow P3.

Returning to FIG. 4, the configuration of the actuator unit 21 will be described. The actuator unit 21 is connected to the surface of the cavity plate 22. Actually, the four actuator units 21*a* to 21*d* are connected to the cavity plate 22.

The actuator unit 21 comprises four piezoelectric sheets 41, 42, 43, and 44, a common electrode 37, an inner electrode 38, the individual electrodes 36, etc. The thickness of each of the piezoelectric sheets 41 to 44 is approximately 15 μm. The thickness of the actuator unit 21 is approximately 60 μm. Each of the piezoelectric sheets 41 to 44 has approximately the same area as the one actuator unit 21 shown in FIGS. 2 and 3. That is, the piezoelectric sheets 41 to 44 each have a trapezoid shape when viewed from a plan view. The piezoelectric sheets 41 to 44 extend across the plurality of pressure chambers 10. The piezoelectric sheets 41 to 44 are formed from ferroelectric lead zirconate titanate (PZT) ceramic material.

The common electrode 37 is disposed between the uppermost piezoelectric sheet 41 and the piezoelectric sheet 42 formed below the piezoelectric sheet 41. The common electrode 37 has approximately the same area as the piezoelectric sheets 41 to 44, and has a trapezoid shape when viewed from a plan view. The common electrode 37 has a thickness of approximately 2 μm. The common electrode 37 is made from a metal material such as, for example, Ag—Pd. Electrodes are not disposed between the piezoelectric sheet 42 and the piezoelectric sheet 43. The inner electrode 38 is disposed between the piezoelectric sheet 43 and the piezoelectric sheet 44. The inner electrode 38 has approximately the same area as the piezoelectric sheets 41 to 44, and has a trapezoid shape when viewed from a plan view. The inner electrode 38 has a thickness of approximately 2 μm. The inner electrode 38 is made from the same material as the common electrode 37. Electrodes are not disposed between the piezoelectric sheet 44 and the cavity plate 22. In this embodiment, the actuator unit 21 comprises the inner electrode 38. The inner electrode 38 does not function as an electrode for obtaining piezoelectric effects. Instead, when the inner electrode 38 is inserted, the piezoelectric sheets 41 to 44, the common electrode 37 and the inner electrode 38 are disposed symmetrically in an up-down direction. As a result, a warp or bend does not readily occur when these are annealed at high temperatures.

A plurality of the individual electrodes 36 that has a thickness of 1 μm is disposed on the surface of the uppermost piezoelectric sheet 41. Each individual electrode 36 is disposed in a position corresponding to one of each of the pressure chambers 10. The individual electrodes 36 are made from a metal material such as, for example, Ag—Pd. A land 36*a* having a thickness of approximately 15 μm is formed at one end of each individual electrode 36. The lands 36*a* are substantially circular when viewed from a plan view, and the diameter thereof is approximately 160 μm. The individual electrodes 36 and the lands 36*a* are joined conductively. The lands 36*a* may be composed of, for example, metal that contains glass flit. The lands 36*a* electrically connect the individual electrodes 36 with the FPC 50. The individual electrodes 36 are electrically connected with a driver IC 80 (to be described; see FIG. 9) via the FPC 50. The driver IC 80 is controlled by the controller 101. The controller 101 can thus individually control the electric potential of each of the individual electrodes 36.

Figure 5:
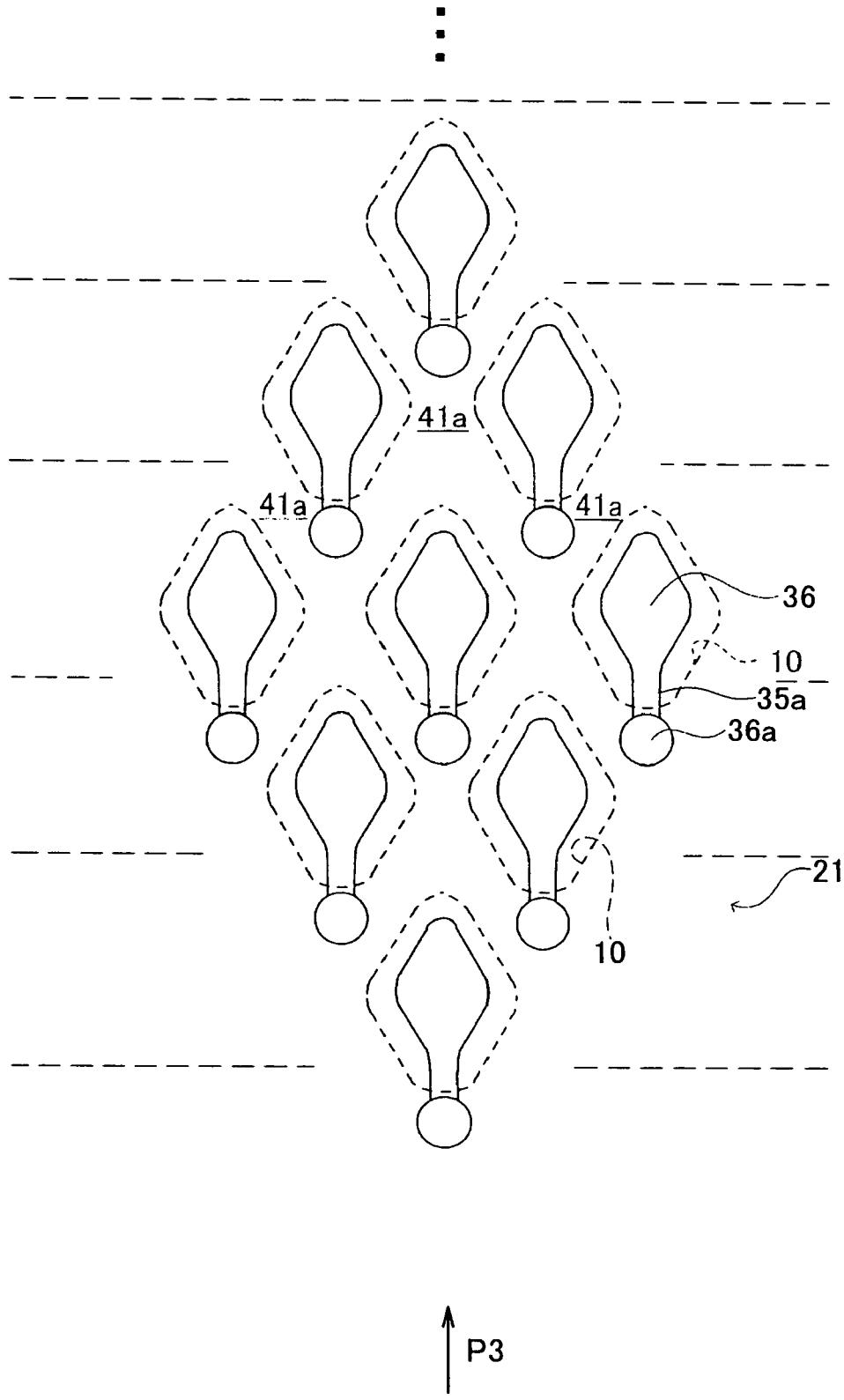
FIG. 5 shows an expanded plan view of a portion of an actuator unit.

FIG. 5 shows an expanded plan view of a portion of the actuator unit 21. As shown in FIG. 5, the individual electrodes 36 are substantially diamond shaped when viewed from a plan view. One individual electrode 36 faces one pressure chamber 10. The individual electrodes 36 are smaller than the pressure chambers 10. The major part of the individual electrodes 36 overlaps with the pressure chambers 10. A protruding part 35*a* is formed on the individual electrodes 36. This protruding part 35*a* extends downwards from an acute angle of a lower side of the diamond shape (the lower side of FIG. 5). The protruding part 35*a* extends to regions 41*a* in which the pressure chambers 10 are not formed. The lands 36*a* are formed in these regions 41*a*.

Since one individual electrode 36 faces one pressure chamber 10, the individual electrodes 36 are aligned with the same pattern as the pattern with which the pressure chambers 10 are aligned. That is, the plurality of individual electrodes 36 that is aligned in the direction orthogonal to the arrow P3 form electrode rows. Sixteen electrode rows are aligned in the direction of the arrow P3 within one actuator unit 21.

In the present embodiment, the individual electrodes 36 are formed only on the uppermost surface of the actuator unit 21. As will be described in detail later, only the piezoelectric sheet 41 between the common electrode 37 and the individual electrodes 36 forms an activated part of the piezoelectric sheets. With this type of configuration, the unimorph deformation in the actuator unit 21 has superior deformation efficiency.

When an electric potential difference is applied between the common electrode 37 and the individual electrodes 36, a region of the piezoelectric sheet 41 to which the electric field is applied deforms due to piezoelectric effects. The deformed part functions as an active part. The piezoelectric sheet 41 can expand and contract in its direction of thickness (the stacking direction of the actuator unit 21), and can expand and contract in a planar direction. The other piezoelectric sheets 42 to 44 are non-active layers that are not located between the individual electrodes 36 and the common electrode 37. Consequently, they cannot deform spontaneously even when an electric potential difference is applied between the individual electrodes 36 and the common electrode 37. In the actuator unit 21, the upper piezoelectric sheet 41 that is farther from the pressure chambers 10 is the active part, and the lower piezoelectric sheets 42 to 44 that are closer to the pressure chambers 10 are non-active parts. This type of actuator unit 21 is termed a unimorph type.

When an electric potential difference is applied between the common electrode 37 and the individual electrodes 36 such that the direction of the electric field and the direction of polarization have the same direction, the active part of the piezoelectric sheet 41 contracts in a planar direction. By contrast, the piezoelectric sheets 42 to 44 do not contract. There is thus a difference in the rate of contraction of the piezoelectric sheet 41 and the piezoelectric sheets 42 to 44. As a result, the piezoelectric sheets 41 to 44 (including the common electrode 37 and the inner electrode 38) deform so as to protrude towards the pressure chamber 10 side. The pressure of ink in the pressure chambers 10 is thus increased, and the ink is discharged from the nozzles 8. By contrast, when there is zero electric potential difference between the common electrode 37 and the individual electrodes 36, the state wherein the piezoelectric sheets 41 to 44 protrude towards the pressure chamber 10 is released. The pressure in the pressure chambers 10 is thus decreased, and the ink is led from the ink chamber E1 into the pressure chambers 10.

The electric potential of the individual electrodes 36 is controlled individually. There is deformation of the parts of the piezoelectric sheets 41 to 44 facing the individual electrodes 36 in which the electric potential has been changed. One piezoelectric element 20 (see FIG. 4) is formed from one individual electrode 36 and the region facing that individual electrode 36 (the region of the piezoelectric sheets 41 to 44 (i.e. the common electrode 37 and the inner electrode 38)). Only one piezoelectric element 20 has been shown in FIG. 4. However, there is the same number of piezoelectric elements 20 as the number of individual electrodes 36 (the same number as the number of pressure chambers 10). The piezoelectric elements 20 are aligned with the same pattern as the pattern with which the individual electrodes 36 are aligned. That is, element rows are formed from a plurality of the piezoelectric elements 20 that is aligned in the direction of P3. Sixteen element rows are aligned in the direction of P3 within one actuator unit 21. Each piezoelectric element 20 faces a different pressure chamber 10. The electric potential of each piezoelectric element 20 is controlled individually by the controller 101.

Figure 6:
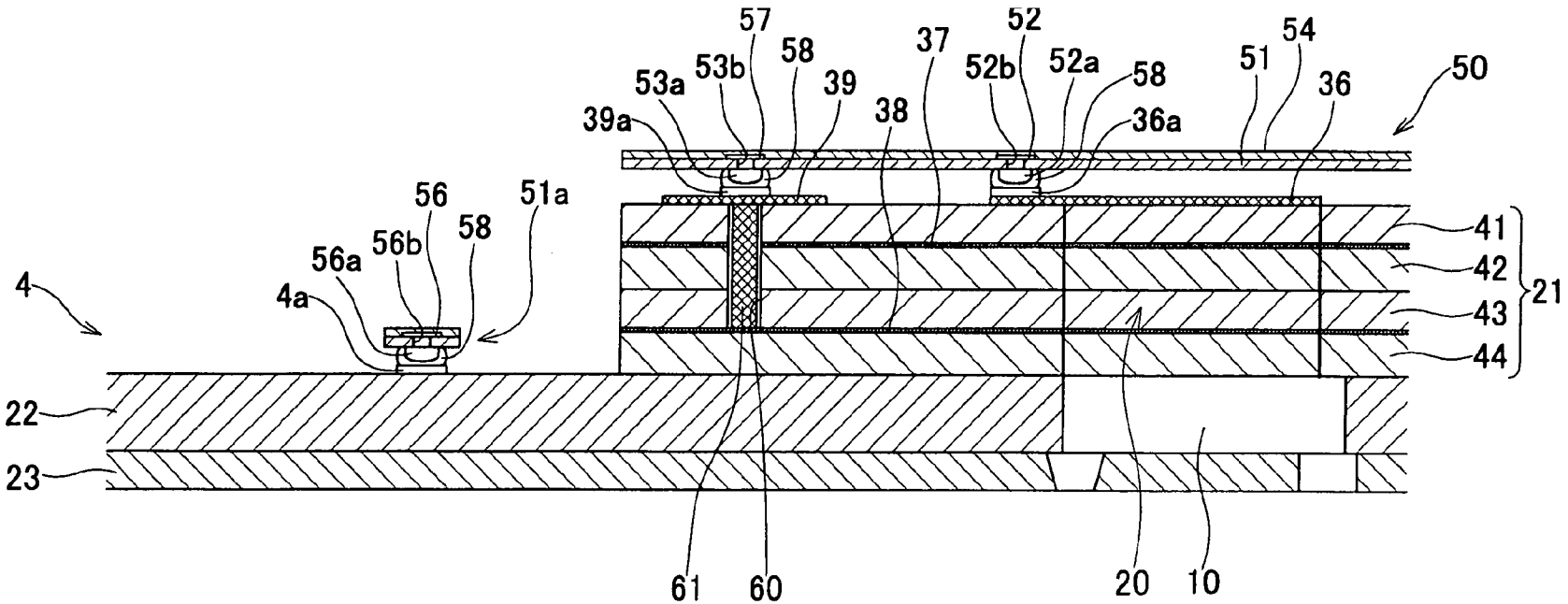
FIG. 6 shows a cross-sectional view of a portion of the actuator unit and an ink passage body.

Next, the configuration of the actuator unit 21 and the FPC 50 will be described in more detail with reference to FIG. 6. FIG. 6 shows a cross-sectional view of the surroundings of the actuator unit 21. In FIG. 6, only two plates 22 and 23 of the ink passage body 4 are shown.

A surface electrode 39 is formed on the surface of the uppermost piezoelectric sheet 41. A land 39*a* is formed on a surface of the surface electrode 39. A through hole 60 is formed in the piezoelectric sheets 41 to 43 in a location facing the land 39*a*. A conductor 61 is inserted into the through hole 60. The conductor 61 electrically connects the surface electrode 39, the common electrode 37, and the inner electrode 38. The electrodes 36, 37, 38, and 39 are connected with the FPC 50 (described next).

Next, the configuration of the FPC 50 will be described. The FPC 50 is disposed above the actuator unit 21. The FPC 50 comprises a base film 51, and a cover film 54 that covers almost the entirety of the base film 51, etc. A plurality of wirings 52, 57, etc. is formed in the base film 51.

Figure 7:
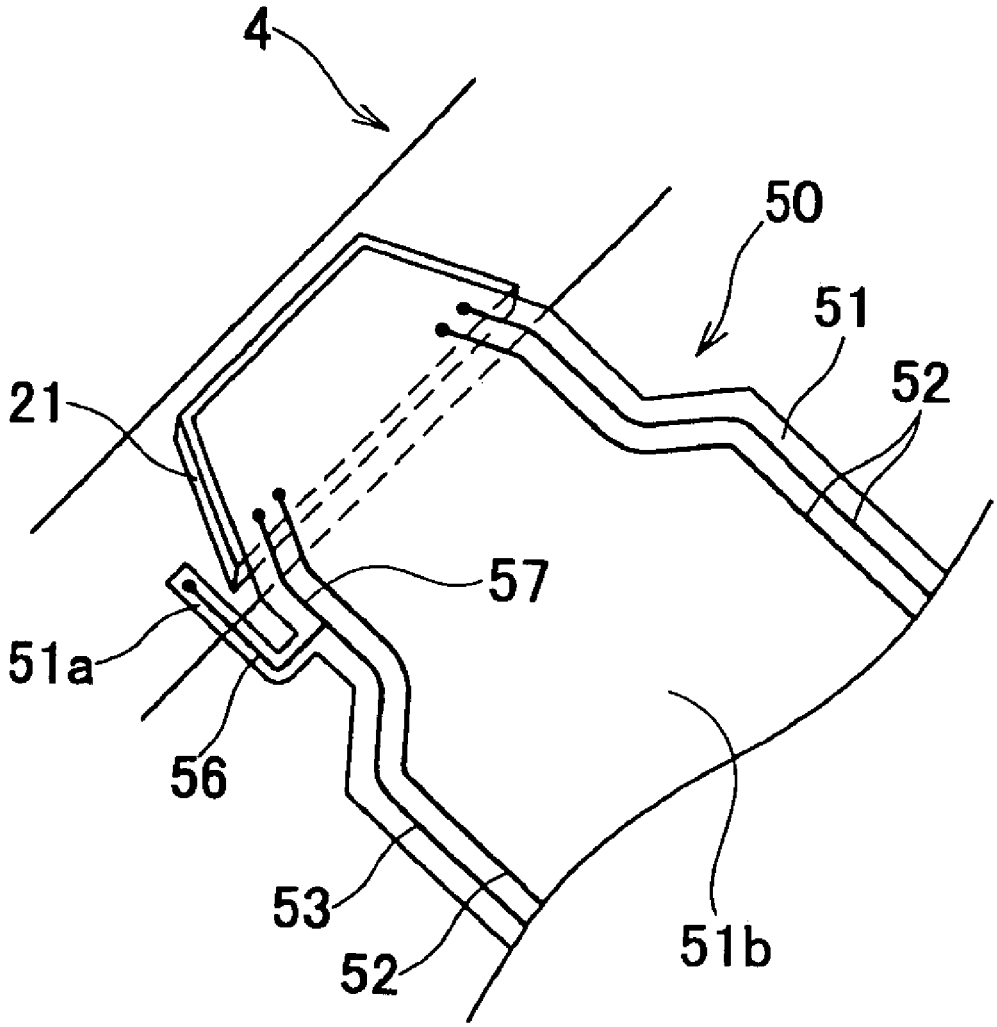
FIG. 7 shows a plan view of a portion of a wiring board.

FIG. 7 shows a plan view of a portion of the FPC 50. In FIG. 7, the cover film 54 has been omitted. The base film 51 has a base portion 51*b* and a projection portion 51*a*. A first main wiring 53 and a plurality of second main wirings 52 are formed on the base portion 51*b*. In FIG. 7, only three second main wirings 52 are shown. Actually, however, there is the same number of second main wirings 52 as the number of individual electrodes 36 included in one actuator unit 21. The first main wiring 53 branches into a first wiring 57 and a second wiring 56. The first wiring 57 is formed on the base portion 51*b*. The second wiring 56 is formed on the projection portion 51*a*. The wirings 52, 53, 56, 57 are formed from copper foil.

As shown in FIG. 6, the second main wiring 52 is connected with a terminal 52*a* of the FPC 50 via a through hole 52*b*. The terminal 52*a* is formed from a conductive material such as nickel or the like. The terminal 52*a* covers the through hole 52*b*, and protrudes downward from a lower face of the base film 51. The terminal 52*a* is electrically connected with the land 36*a* via solder 58. With this configuration, the individual electrode 36 is connected with one end of the second main wiring 52. The other individual electrodes 36 not shown in FIG. 6 are also each connected with one end of a different second main wiring 52. The other ends of the second main wirings 52 are connected with the driver IC 80 (to be described: see FIG. 9).

The first wiring 57 (one of the two wirings branching from the first main wiring 53 (see FIG. 7)), is connected with a terminal 53*a* of the FPC 50 via a through hole 53*b*. Like the terminal 52*a*, the terminal 53*a* is also formed from a conductive material such as nickel or the like. The terminal 53*a* covers the through hole 53*b*, and protrudes downward from the lower face of the base film 51. The terminal 53*a* is electrically connected with the land 39*a* via solder 58. With this configuration, the surface electrode 39 is connected with one end of the first wiring 57. That is, the common electrode 37 and the inner electrode 38 are connected with the first wiring 57. As shown in FIG. 7, the first wiring 57 is connected with one end of the first main wiring 53. The other end of the first main wiring 53 is connected with the driver IC 80 (see FIG. 9).

As described above, the second wiring 56 is formed in the projection portion 51*a* shown in FIG. 7. The second wiring 56 is connected with the ink passage body 4. As shown in FIG. 6, the second wiring 56 is connected with a terminal 56*a* via a through hole 56*b*. A contact 4*a* is formed on the surface of the ink passage body 4. The terminal 56*a* is electrically connected with the contact 4*a* via solder 58. With this configuration, one end of the second wiring 56 is connected with the ink passage body 4. The other end of the second wiring 56 is connected with one end of the first main wiring 53 shown in FIG. 7. The other end of the first main wiring 53 is connected with the driver IC 80 (see FIG. 9).

Although this will be described in detail later, the first main wiring 53 is connected with a ground in the present embodiment. As a result, the electric potentials of the common electrode 37, the inner electrode 38, and the ink passage body 4 are maintained at ground electric potential.

Figure 8:
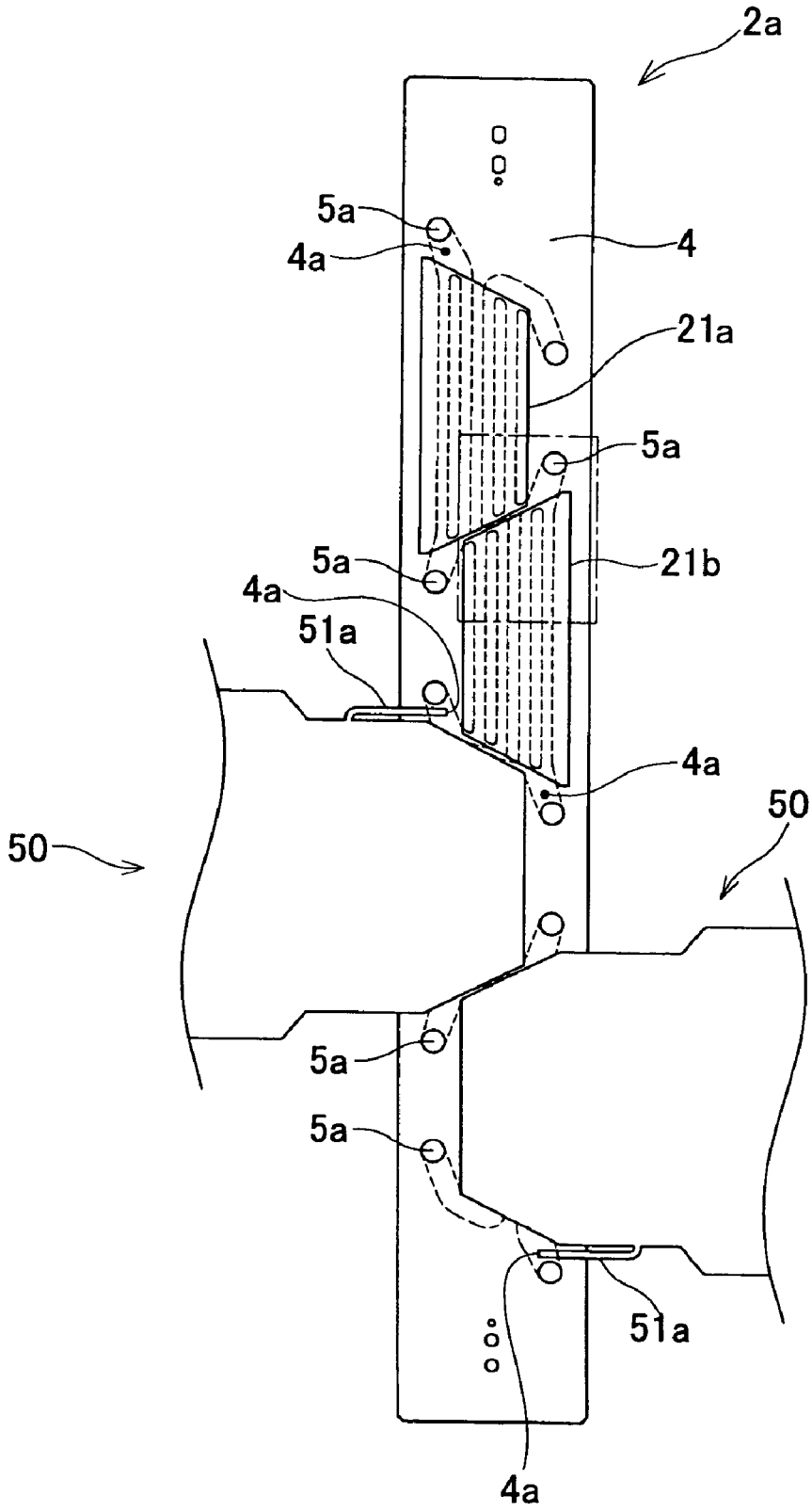
FIG. 8 shows how two wiring boards are connected to the ink jet head.

FIG. 8 shows how two FPCs 50 are connected to the ink jet head 2*a*. One FPC 50 is connected with one actuator unit 21. Consequently, four FPCs 50 are connected with one ink jet head 2*a*. In FIG. 8, only two FPCs 50 are shown.

The four actuator units 21 are aligned in a staggered pattern in the longitudinal direction of the ink passage body 4. In the present embodiment, the FPC 50 extends from the short side towards the long side of the actuator units 21. That is, two adjacent FPCs 50 extend in opposing directions. The projection portion 51*a* of the FPC 50 is formed at a right side in the direction in which the FPC 50 is extending. The plurality of ink openings 5*a* is formed on the ink passage body 4. The projection portions 51*a* extend so as to avoid these ink openings 5*a*.

Four contacts 4*a* (see FIG. 6) to which four FPCs 50 are connected are formed on the ink passage body 4. The contacts 4*a* of the two actuator units that are adjacent in the longitudinal direction of the ink passage body 4 are offset in the widthwise direction of the ink passage body 4. The lowermost contact 4*a* and the contact 4*a* thereabove are disposed in the same position with respect to the widthwise direction of the ink passage body 4. The uppermost contact 4*a* and the contact 4*a* therebelow are disposed in the same position with respect to the widthwise direction of the ink passage body 4. The contacts 4*a* could be said to be disposed in a staggered pattern. Further, the two contacts 4*a* at the ends in the longitudinal direction of the ink passage body 4 are disposed outwards with respect to the two actuator units 21 at the ends. The four contacts 4*a* are distributed across a wide range of the ink passage body 4. As a result, the entire area of the ink passage body 4 can have an identical electric potential without bias. In the present embodiment, the entirety of the ink passage body 4 has ground electric potential.

Figure 9:
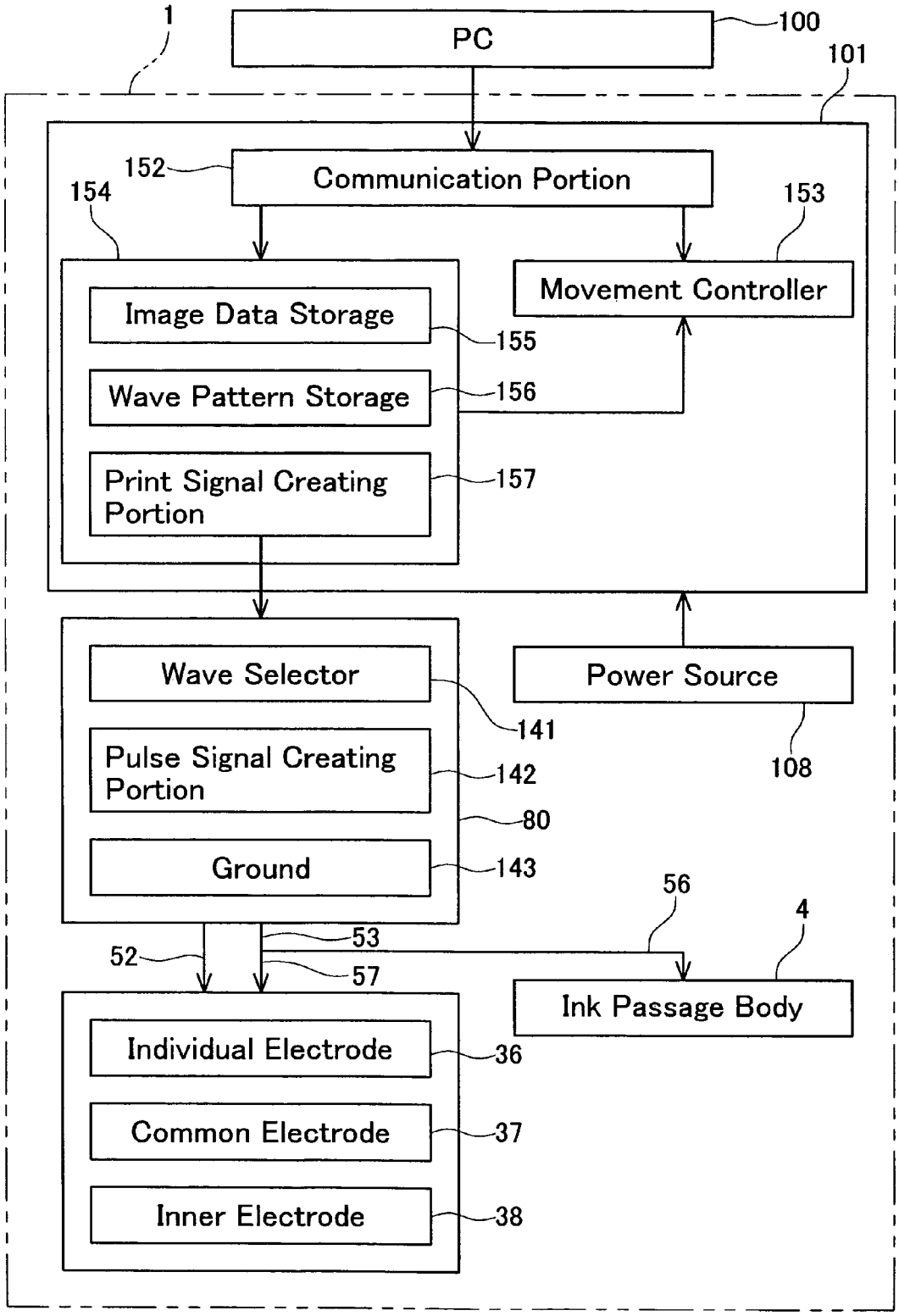
FIG. 9 shows the circuit configuration of a controller and its surrounds.

Next, the controlling configuration for the printer 1 will be described. FIG. 9 is a block view showing the controlling configuration for the printer 1. As shown in FIG. 9, the controller 101 is provided within the printer 1. The controller 101 comprises a CPU (Central Processing Unit), a ROM (Read Only Memory), a RAM (Random Access Memory), etc. The CPU is a processing unit. The CPU executes programs stored in the ROM. The ROM stores programs to be executed by the CPU, and stores data used in the execution of these programs. The RAM temporarily stores data used when executing the programs. These allow the functions described below to be realized.

The controller 101 operates on the basis of print data output from a PC 100. The controller 101 comprises a communication portion 152, a movement controller 153, a print controlling portion 154, etc. The communication portion 152 communicates with the PC 100. The print data output from the PC 100 contains image data and operation data. The communication portion 152 outputs the operation data to the movement controller 153, and outputs the image data to the print controlling portion 154.

A power source 108 is connected with the controller 101. The power source 108 creates electric potential required for the signals utilized by the printer 1 from an AC power supply, and supplies this electric potential to the controller 101. For example, the power source 108 creates electric potential required for a high electric potential signal in which standby electric potential is maintained, for a base signal in which ground electric potential is maintained, and for a low electric potential signal in which a positive electric potential lower than the standby electric potential is maintained. In the present embodiment, the power source 108 creates an electric potential of 20 V for the high electric potential signal, and an electric potential of 3.3 V for the low electric potential signal. Further, the power source 108 creates the ground electric potential. The high electric potential signal and the low electric potential signal may each be provided with one wiring for the base signal.

The movement controller 153 controls the paper supply device 114, the conveying unit 120, etc. (see FIG. 1) based on instructions from the PC 100 and the print controlling portion 154.

The print controlling portion 154 comprises an image data storage 155, a wave pattern storage 156, a print signal creating portion 157, etc. The image data (bit-mapped data) output from the PC 100 is stored in the image data storage 155. The image data includes a plurality of combinations of coordinate and gradation value (8 bits (256 gradations)) of the color (CMYK). The wave pattern storage 156 stores three types of wave pattern 161 to 163 (see FIG. 10) of the discharging signals supplied to each of the individual electrodes 36. The print signal creating portion 157 creates print signals based on the data stored in the image data storage 155. The print signals are 2 bit serial signals.

Figure 10:
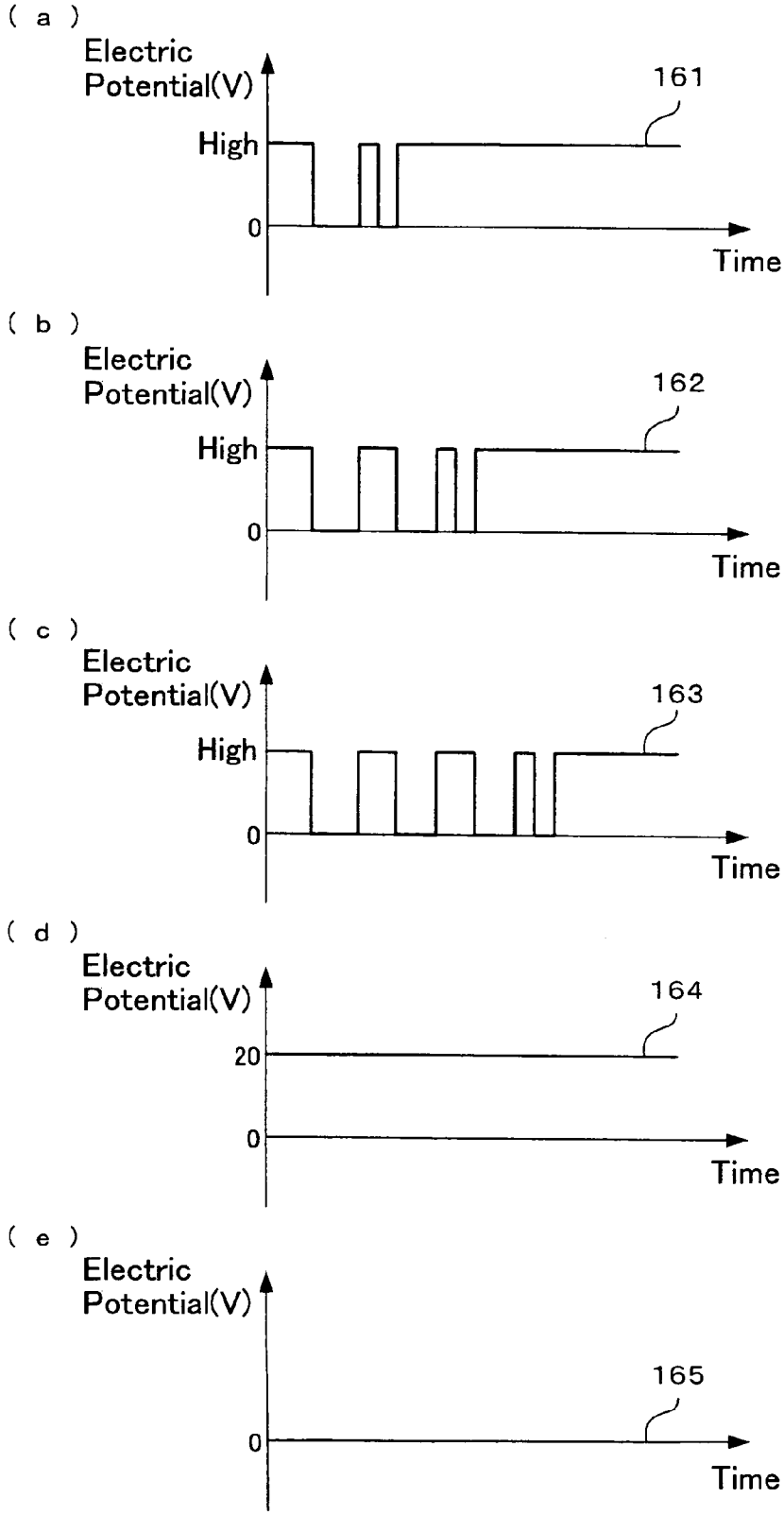
FIG. 10(*a*) shows one discharging pulse signal and one canceling pulse signal.

The three types of discharging signals 161 to 163 are shown in FIG. 10(*a*) to (*c*). FIG. 10(*d*) shows a high electric potential signal 164 (equivalent to a standby signal; to be described). FIG. 10(*e*) shows a base potential signal 165. In each of the FIGS. 10(*a*) to (*e*), electric potential is on the vertical axis, and time is on the horizontal axis.

The wave pattern signal 161 shown in FIG. 10(*a*) is used to form one dot on the printing paper P using one ink droplet. When this signal 161 is applied to the piezoelectric element 20, the electric potential of the piezoelectric element 20 changes in the sequence: high electric potential, low electric potential, high electric potential. When the electric potential of the piezoelectric element 20 is high, the piezoelectric element 20 protrudes towards the pressure chamber 10. When the electric potential changes from high to low, the piezoelectric element 20 returns to its original shape (the shape in FIG. 4). At this juncture, the ink is led from the ink chamber into the pressure chamber 10. Then, when the electric potential changes from low to high, the piezoelectric element 20 again protrudes towards the pressure chamber 10. The pressure of the ink within the pressure chamber 10 is thus increased, and one droplet of ink is discharged from the nozzle 8. In FIG. 10(*a*), the final pulse is a canceling pulse for canceling pressure remaining within the passage (the passage from the nozzle 8 to the ink chamber). The canceling pulse creates a new pressure wave that reverses the pressure wave of the remaining pressure. The remaining pressure is thus cancelled out.

The wave pattern signal 162 shown in FIG. 10(*b*) is used to form one dot on the printing paper P using two ink droplets. When this signal 162 is applied to the piezoelectric element 20, the above deformation is repeated twice. In this case, two droplets of ink are discharged continuously from the nozzle 8. In FIG. 10(*b*), the final pulse is a canceling pulse.

The wave pattern signal 163 shown in FIG. 10(*c*) is used to form one dot on the printing paper P using three ink droplets. When this signal 163 is applied to the piezoelectric element 20, the above deformation is repeated three times. In this case, three droplets of ink are discharged continuously from the nozzle 8. In FIG. 10(*c*), the final pulse is a canceling pulse.

In the wave pattern signals 161 to 163 shown in FIG. 10(*a*) to (*c*), the high level electric potential is, for example, 3.3 V. Although this will be described later, the wave pattern signals 161 to 163 are amplified by the driver IC 80 such that the high level electric potential becomes 20 V.

In the wave pattern signals 161 to 163, the pulse widths that are not the canceling pulse are set to be AL. Further, in the wave pattern signals 162 and 163, a time between two adjacent pulse that are not the canceling pulse is also set to be AL. AL is the time for a pressure wave created within the pressure chamber 10 to proceed from the nozzle 8 to the ink chamber.

As shown in FIG. 9, the print controlling portion 154 is connected with the driver IC 80 that is formed on the FPC 50. The print controlling portion 154 supplies the following to the driver IC 80: the print signals created by the print signal creating portion 157, the three wave pattern signals stored in the wave pattern storage 156, and a high electric potential signal 164 and a base signal (ground electric potential) 165.

The driver IC 80 comprises a wave selector 141, a pulse signal creating portion 142, and a ground 143. Based on the print signal, the wave selector 141 selects which wave pattern out of the three wave pattern signals 161 to 163 and the high electric potential signal 164 will be applied to the individual electrodes 36. The pulse signal creating portion 142 amplifies the signal selected by the wave selector 141 such that the high level electric potential becomes 20 V. The driver IC 80 supplies the amplified signal to the individual electrodes 36 via the second main wirings 52 of the FPC 50. The pulse signal (any out of 161 to 163) is thus applied to the individual electrodes 36 with a timing that corresponds to the image data. Furthermore, the standby signal (the high electric potential signal 164) is applied to the individual electrodes 36 throughout the time until the discharging signal is applied to the individual electrodes 36.

The first main wiring 53 of the FPC 50 is connected with the ground 143. The base signal (the ground electric potential) 165 is usually applied to the ink passage body 4 via the first main wiring 53 and the second wiring 56. Further, the base signal (the ground electric potential) 165 is usually applied to the common electrode 37 and the inner electrode 38 via the first main wiring 53 and the first wiring 57. As a result, the ink passage body 4, the common electrode 37, and the inner electrode 38 are maintained at the ground electric potential.

Since the ink passage body 4 is connected with the ground, the ink passage body 4 does not assume a positive or a negative electric potential even if it makes contact with a charged printing paper P. Furthermore, the common electrode 37 and the inner electrode 38 are also connected with the ground. As a result, an electric potential difference is not created between the ink passage body 4 and the inner electrode 38 (or the common electrode 37).

The present inventors discovered that the actuator unit 21 may be damaged if the electric potential of the inner electrode 38 (or the common electrode 37) of the actuator unit 21 becomes higher than the electric potential of the ink passage body 4. It was assumed that this phenomenon is caused by the following: if the electric potential of water within the pressure chamber 10, electric polarization of the water occurs, and hydrogen ions are created. The electric potential difference between the ink passage body 4 and the inner electrode 38 of the actuator unit 21 causes components of the ink (mainly hydrogen ions) to enter the actuator unit 21. Although the actuator unit 21 has been sintered, it is most likely to be a structure in which hydrogen ions can move. The hydrogen ions within the actuator unit 21 may reach the electrodes 36 to 38. The electrodes 36 to 38 are formed from Ag/Pd metal, and Pd has the property of occluding hydrogen ions. Hydrogen gas may be created when hydrogen ions are occluded in the electrodes 36 to 38 and, if hydrogen gas is created, there is the possibility that the sheets 36, 37, 38, and 41 to 44 of the actuator unit 21 may separate, thus damaging the actuator unit 21. Since the ink passage body 4, the common electrode 37 and the inner electrode 39 are always maintained at the ground electric potential in the present embodiment, the components of the ink can be prevented from entering the actuator unit 21. The ink jet printer 1 of the present embodiment therefore has a long life and a stable ink discharging performance.

Further, as described above, the contacts 4*a* (see FIG. 6) are distributed uniformly on the ink passage body 4. As a result, even if the electric charge is conveyed into the ink passage body 4, the ink passage body 4 will rapidly return to the ground electric potential. This contributes to preventing damage to the control circuit, etc. caused by electrical discharge.

Some representative modifications to the aforementioned embodiment are listed here.

(1) The aforementioned embodiment may be applied to a serial type printer in which the ink jet heads move.

(2) The ink passage body 4, the common electrode 37 and the inner electrode 38 may not be electrically connected. The electric potentials may be controlled individually such that the electric potential of the ink passage body 4 is equal to or below the electric potential of the inner electrode 38, and so that the electric potential of the inner electrode 38 is equal to or below the electric potential of the common electrode 37.

(3) The inner electrode 38 may be omitted. In this case, the ink passage body 4 and the common electrode 37 may be electrically connected. Further, the ink passage body 4 and the common electrode 37 may not be electrically connected. In this case, the electric potentials may be controlled individually such that the electric potential of the ink passage body 4 is equal to or below the electric potential of the common electrode 37.

(4) The actuator unit 21 may not have a trapezoid shape when viewed from a plan view. The actuator unit 21 may have a parallelogram shape or have a polygonal shape with five or more sides. The actuator units 21 may not be disposed in a staggered pattern in the longitudinal direction of the ink passage body 4. For example, a plurality of actuator units 21 may be aligned in a row.

(5) In the aforementioned embodiment, one FPC 50 has one projection portion 51*a*. However, one FPC 50 may have a plurality of projection portions 51*a*. In this case, the projection portions 51*a* may be formed at both sides of the FPC 50. One second wiring 56 is formed on each of the projection portions 51*a*, and each second wirings 56 is connected with the ink passage body 4. If this is done, the second wirings 56 can be connected stably with the ink passage body 4. Moreover, the contacts 4*a* of the ink passage body 4 may be disposed further toward the periphery than in the present embodiment.

(6) In the aforementioned embodiment, the ink passage body 4 is formed by stacking metal plates. However, a resin film such as polyimide may be utilized as the nozzle plate 30. Although this nozzle plate 30 is easily charged, it is possible to prevent the ink from being charged since the remaining plates 22 to 29 are maintained at ground electric potential.

(7) The technique for applying electric potential to the piezoelectric elements 20 is not restricted to the technique described in the above embodiment. For example, when the ink droplet is to be discharged in the above embodiment, the electric potential of the piezoelectric element 20 is changed in the sequence: high electric potential, low electric potential, high electric potential. This sequence may be changed to: low electric potential, high electric potential, low electric potential.

(8) The ground 143 may be connected to a case (not shown) of the printer 1 in order to maintain ground electric potential of the ink passage body 4, the common electrode 37 and the inner electrode 38.

What is claimed is:

1. An ink jet printer, comprising:

an ink jet head comprising an ink passage body and an actuator, the ink passage body comprising a nozzle, an ink chamber communicating with the nozzle, and a pressure chamber located between the nozzle and the ink chamber, the actuator comprising a piezoelectric element facing the pressure chamber, the piezoelectric element comprising a piezoelectric layer, a first electrode connected with a front face of the piezoelectric layer, a second electrode connected with a back face of the piezoelectric layer, and a first insulator located between the second electrode and the ink passage body; and a device that maintains the electric potentials of the ink passage body and the second electrode such that the electric potential of the ink passage body is equal to or below the electric potential of the second electrode, the ink passage body comprises a plurality of nozzles, a plurality of pressure chambers, and a contact formed on a surface of the ink passage body, each nozzle corresponds with a different pressure chamber, the actuator comprises a plurality of piezoelectric elements, each piezoelectric element faces a different pressure chamber, the piezoelectric elements share the piezoelectric layer and the second electrode, each piezoelectric element has its own first electrode, the device comprises a wiring board and a conductive connector, the wiring board comprises:

a board, a first wiring formed on the board, a second wiring formed on the board, and a first main wiring formed on the board, wherein the first wiring is connected with the second electrode, the second wiring is connected with the ink passage body, the first main wiring branches into the first wiring and the second wiring, the piezoelectric layer comprises a through hole formed therethrough, the conductive connector is inserted into the through hole, the conductive connector is connected with the second electrode, the first wiring is connected with the conductive connector, and the second wiring is directly connected with the contact.

2. The ink jet printer as in claim 1, wherein the first insulator is formed from piezoelectric material.

3. The ink jet printer as in claim 1, wherein the wiring board comprises a plurality of second main wirings formed on the board, and each second main wiring is connected with a different first electrode.

4. The ink jet printer as in claim 3, wherein the board comprises a base portion and a projection portion projecting from the base portion, the first wiring, and the second main wirings are formed on the base portion, and the second wiring is formed on the projection portion.

5. The ink jet printer as in claim 1, wherein the device comprises a plurality of wiring boards, the ink jet head comprises a plurality of actuators, and each wiring board corresponds with a different actuator.

6. The ink jet printer as in claim 5, wherein each actuator is aligned along a longitudinal direction of the ink passage body, the ink passage body comprises a plurality of contacts, each contact corresponds with a different wiring board, each contact is connected with the second wiring of the corresponding wiring board, and the contacts include at least two contacts which are offset along a direction perpendicular to the longitudinal direction of the ink passage body.

7. The inkjet printer as in claim 1, wherein the piezoelectric element comprises a conductor located between the first insulator and the ink passage body, and the device maintains the electric potentials of the ink passage body and the conductor such that the electric potential of the ink passage body is equal to or below the electric potential of the conductor.

8. The inkjet printer as in claim 7, wherein the piezoelectric element comprises a second insulator located between the conductor and the ink passage body.

9. The inkjet printer as in claim 8, wherein the second insulator is formed from piezoelectric material.

10. The ink jet printer as in claim 7, wherein the device maintains the electric potentials of the conductor and the second electrode such that the electric potential of the conductor is equal to or below the electric potential of the second electrode.

11. The inkjet printer as in claim 10, wherein the device maintains the electric potentials of the conductor and the second electrode such that the electric potential of the conductor is equal to the electric potential of the second electrode.

12. The inkjet printer as in claim 11, wherein the device comprises a connector which electrically connects the conductor with the second electrode.

13. The inkjet printer as in claim 11, wherein the device maintains the electric potentials of the ink passage body, the conductor, and the second electrode such that the electric potentials of the ink passage body, the conductor, and the second electrode are equal.

* * * * *